US009486662B2

(12) United States Patent
Eder et al.

(10) Patent No.: US 9,486,662 B2
(45) Date of Patent: Nov. 8, 2016

(54) HANDLE WITH RETRACTABLE PLUNGER

(71) Applicant: IncludeFitness, Inc., Cincinnati, OH (US)

(72) Inventors: James Ryan Eder, Columbus, OH (US); Jamison Joseph Float, Galloway, OH (US)

(73) Assignee: IncludeFitness, Inc., Cincinnati, OH (US)

( * ) Notice: Subject to any disclaimer, the term of this patent is extended or adjusted under 35 U.S.C. 154(b) by 279 days.

(21) Appl. No.: 14/166,635

(22) Filed: Jan. 28, 2014

(65) Prior Publication Data

US 2014/0210218 A1 Jul. 31, 2014

Related U.S. Application Data

(60) Provisional application No. 61/757,484, filed on Jan. 28, 2013.

(51) Int. Cl.

| | |
|---|---|
| ***E05B 1/00*** | (2006.01) |
| ***A63B 21/06*** | (2006.01) |
| ***E05C 1/06*** | (2006.01) |

(52) U.S. Cl.

CPC ..... *A63B 21/06* (2013.01); *E05B 1/0053* (2013.01); *E05C 1/06* (2013.01); *Y10T 292/089* (2015.04)

(58) Field of Classification Search

CPC ..... A63B 21/06; E05B 1/003; E05B 1/0053; E05B 85/10; E05B 2001/0076; E05C 1/06; Y10T 292/57; Y10T 292/089

USPC ..... 292/336.3, 347, 348; 248/407, 408, 248/125.8; 403/321, 322.4, 324, 379.2; 482/148; 297/344.22

See application file for complete search history.

(56) References Cited

U.S. PATENT DOCUMENTS

| | | | |
|---|---|---|---|
| 701,238 | A | 5/1902 | Williams |
| 814,439 | A | 3/1906 | Fraser |

(Continued)

*Primary Examiner* — James O Hansen

(74) *Attorney, Agent, or Firm* — Jason H. Foster; Kremblas & Foster

(57) ABSTRACT

An apparatus that retracts a plunger along an axis about which a handle pivots. The handle has two ends that are perpendicular, the second end having a sidewall with a barrel forming a chamber in which the plunger is slidably mounted. The sidewall has elongated slots through which opposing roller bars that extend from the plunger protrude through. A collar body is rotatably mounted to the second end and has opposing openings with triangular surfaces. The roller bars rest on the triangular surfaces, and when the first end of the handle is rotated about the central axis, the slot sidewalls drive the roller bars around the triangular surfaces, thereby causing axial movement of the plunger away toward the first end of the handle without moving the first end to move out of the plane in which it rotates.

10 Claims, 5 Drawing Sheets

(56) References Cited

U.S. PATENT DOCUMENTS

| | | | | |
|---|---|---|---|---|
| 1,616,199 | A | 2/1927 | Rosine | |
| 1,775,577 | A | 9/1930 | Wilson | |
| 2,113,753 | A | 4/1938 | Wilson | |
| 2,800,806 | A | 7/1957 | Sangster | |
| 3,127,786 | A | 4/1964 | Wooley | |
| 3,770,236 | A | 11/1973 | Marsh et al. | |
| 3,910,633 | A | 10/1975 | Marsh | |
| 4,165,854 | A | 8/1979 | Duly | |
| 4,938,122 | A | 7/1990 | Ziemba | |
| 6,378,928 | B1 | 4/2002 | Downey | |
| 6,578,884 | B2 * | 6/2003 | Chiang | E05B 1/0092 292/200 |
| 7,237,785 | B2 | 7/2007 | Kraus et al. | |
| 7,364,533 | B2 | 4/2008 | Baker | |
| 7,383,962 | B2 | 6/2008 | Webster et al. | |
| 7,980,519 | B2 | 7/2011 | Chen | |
| 8,167,319 | B2 | 5/2012 | Ogawa | |
| 2005/0147464 | A1 | 7/2005 | Lee | |
| 2008/0113852 | A1 * | 5/2008 | Caldwell | A63B 21/00047 482/133 |
| 2012/0018475 | A1 * | 1/2012 | Cooper | B60R 11/02 224/401 |

* cited by examiner

HANDLE WITH RETRACTABLE PLUNGER

CROSS-REFERENCES TO RELATED APPLICATIONS

This application claims the benefit of U.S. Provisional Application No. 61/757,484 filed Jan. 28, 2013. The prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates generally to mechanisms for retracting a plunger, and more particularly to mechanisms for retracting a plunger upon rotation of a handle.

It is often desirable to retract a plunger that extends into another structure in order to move the object from which the plunger extends, or the structure into which the plunger extends. Pivoting and sliding doors and windows commonly use retractable plungers to hold the door or window in place relative to a frame, and then free the door or window for movement once the plunger is retracted. Complex mechanisms are used to retract a plunger along one axis as the result of rotating a handle along another, typically perpendicular axis. Common doorknobs are but one example of such a mechanism. Besides the perpendicular axes, modern doorknobs suffer from the requirement that the user have sufficient ability to grasp the knob while simultaneously rotating. While this is an action that able-bodied humans take for granted, a significant portion of the population suffers from difficulty in such movements. As a result, the L-shaped door handle has become widely used due to its ability to permit entry without the requirement for grasping and rotating. One need merely push the handle near the end farthest from the pivot axis with a small amount of strength or weight, and the plunger is easily retracted. The door is then pushed open.

L-shaped handles retract the plunger along an axis that is perpendicular to the axis of rotation of the handle. This works well in the case of doors and windows, in which the handle is on one side and the plunger extends along the plane of the door into the door jamb or frame. In some situations, however, a plunger must be retracted along the pivot axis of the handle, such as the case in fitness equipment.

Conventional fitness equipment uses weight plates, which are typically cast iron plates, that stack on one another, and through which a bar extends. The top of the bar is connected to a cable or other high-tensile strength flexible material. The opposite end of the cable, after winding through one or more pulleys to direct the cable to a desired location, is attached to a handle for being grasped by the user of the fitness equipment. The location of the handle can often be moved, such as by removing a screw or other fastener, rotating or sliding the handle along a beam or bar, and then inserting and tightening the screw or other fastener into the handle or a collar through which the handle or the attached cable extends. Like conventional doorknobs, however, the use of such fasteners to move components of fitness equipment can be extremely difficult for those without the ability to grasp and rotate.

Therefore, the need exists for a means for fastening that does not require the ability to grasp and rotate.

BRIEF SUMMARY OF THE INVENTION

The present invention contemplates a handle in which the user need merely rotate a first end of an L-shaped handle about the axis of the second end of the handle. The act of rotating the first end actuates a mechanism that retracts a plunger that is coaxial with the axis of rotation of the L-shaped handle. This is advantageous in the case of fitness equipment and other fields.

A mechanism that accomplishes the above plunger retraction includes a handle having at least first and second intersecting end sections that are transverse to one another. Preferably, the second end section has a substantially cylindrical sidewall defining a barrel with a central axis. The sidewall has at least one elongated slot, and preferably two opposing slots, formed in the sidewall and substantially parallel to the central axis. A plunger is longitudinally slidably, mounted in the barrel, and the plunger is coaxial with the central axis. At least one bar, and preferably opposing bars, extends transversely from rigid attachment to the plunger through the elongated slot in the sidewall. A collar body is rotatably mounted to the second end section of the handle, and the collar body has a collar sidewall with at least one surface defining an opening. The opening receives said at least one bar resting upon said at least one surface. Upon rotation of the first end section of the handle about the central axis, the bar follows said at least one surface and drives the plunger longitudinally along the central axis.

In a preferred embodiment, a mechanism for retracting a plunger along a central axis during rotation of a handle about the central axis comprises the handle having first and second substantially perpendicular end sections. The first end section is mounted to pivot about the central axis and the second end section has a substantially cylindrical handle sidewall defining a barrel that is coaxial with the central axis. The handle sidewall has first and second opposed, elongated, substantially parallel slots formed therein that are substantially parallel to the central axis. A plunger is longitudinally slidably, mounted in the barrel, wherein the plunger is coaxial with the central axis. A spring that biases the plunger away from the first end section of the handle is preferably mounted against the handle sidewall and the plunger. First and second opposing roller bars extend from rigid attachment to the plunger through the opposed elongated slots. The handle sidewall is rotatably mounted in a collar body that has a collar sidewall with opposed first and second surfaces defining opposed first and second openings, respectively. Each of the first and second openings receives a respective one of the roller bars resting upon a respective one of the first and second surfaces. Upon rotation of the first end section of the handle about the central axis, the roller bars are driven by surfaces defining the elongated slots to follow the first and second surfaces and drive the plunger longitudinally along the central axis against the bias of the spring, thereby retracting the plunger into the collar body.

The first and second openings are preferably substantially triangular, and in a particularly preferred embodiment first and second fingers extend from a respective end of each of the first and second openings.

Figure 1:
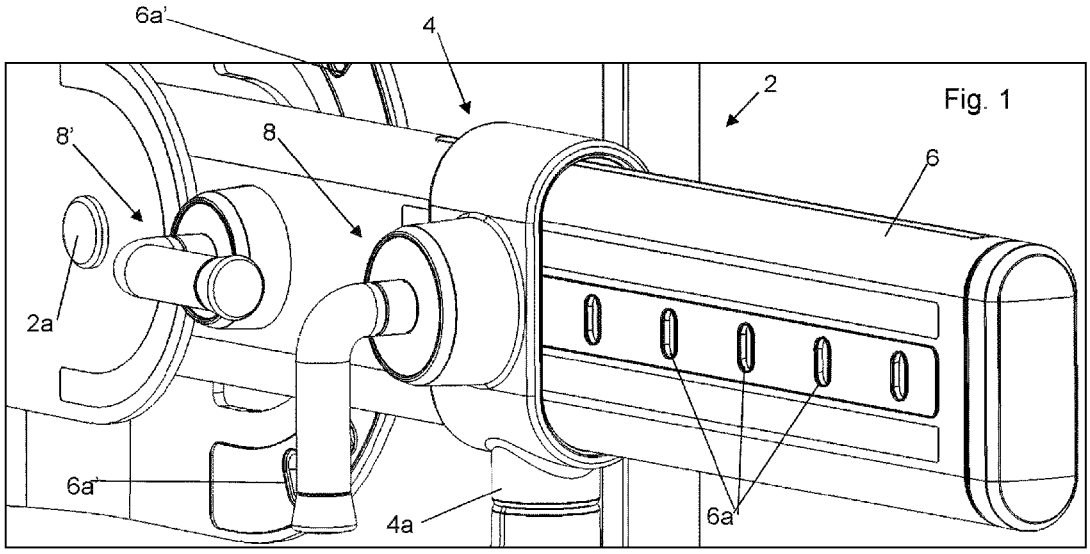
FIG. 1 is a view in perspective illustrating a fitness machine with an embodiment of the present invention mounted thereon.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Provisional patent application Ser. No. 61/757,484, filed Jan. 28, 2013, which is the above claimed priority application, is incorporated in this application by reference.

The preferred apparatus 8 is shown in FIG. 1 attached to a collar 4 that is slidably disposed on the arm 6 of a fitness machine 2. Another apparatus 8' is shown near the pivot point 2*a* of the arm 6. The arm 6 preferably has a plurality of apertures 6*a* that correspond to discrete positions where the collar 4 can be located. A conventional cable (not visible) preferably extends through the arm 6 and out of a slot in the lower surface of the arm 6 into the fitting 4*a* that extends downwardly from the collar 4. A handle (not visible) mounts to the end of the cable below the fitting 4*a*, allowing a user to pull on the cable during a fitness routine or workout in a manner that will be apparent to a person of ordinary skill from the description herein.

The collar 4 is held in its longitudinal position along the arm 6 by a plunger 40 (described below) that extends from the apparatus 8 into one of the apertures 6*a*. The plunger positively locates the apparatus 8, and the attached collar 4, by inserting into one of the apertures 6*a*, thereby locking the collar 4 to the arm 6. Similarly, the arm 6 is held at a selected angle, relative to the surface upon which the fitness machine rests, about the pivot 2*a* by a retractable plunger that extends from the apparatus 8' into one of the apertures 6*a*'. By retracting the plunger, the collar 4 can be moved from the position along the arm 6 where it is located to any of the other positions associated with an aperture 6*a* so that a fitness routine or workout can proceed as the user desires Likewise, the arm 6 can be raised and lowered about the pivot 2*a* by retracting the plunger extending from the apparatus 8'. The preferred structure and operation of the apparatus 8 generally, and the retraction of the plunger thereof particularly, are described below in detail. It should be noted that the use of the apparatus 8 is not limited to the operation described or the equipment referenced herein, but can include other equipment and operations as will become apparent to the person having ordinary skill, and can include a cable attached to a remotely located pin.

The apparatus 8 is shown removed from a fitness machine in FIGS. 2-6. Ordinarily the apparatus 8 is welded, screwed or otherwise firmly fastened to a structure, as to the collar 4 of the fitness machine 2 of FIG. 1. For purposes of explanation, the apparatus 8 is shown and described alone below. The apparatus 8 has a preferably L-shaped handle 10 with a first end section 12 that is joined to a second end section 14 that inserts rotatably into a collar body 20. The first and second end sections 12 and 14 are transverse, and preferably perpendicular, to one another. It is contemplated that a third end section (not shown) can be attached to form a T-shaped handle, and other shapes are likewise contemplated. The L-shaped handle is the fundamental handle shape upon which other enhanced handles can be built, and therefore only this fundamental handle shape is described herein.

The first end 12 is designed for a user to grasp or otherwise contact using his hands, elbows or any other body part, artificial limb, tool or other structure. The second end 14 is configured to rotate about the central axis 14*a* (see FIG. 5) of the second end 14, preferably by moving the first end 12 to one side or the other about the central axis 14*a* during the contact by the user. As noted, the rotation of the second end 14 can be by pushing or pulling the first end 12. In this regard, the handle 10 appears to function much like a conventional L-shaped door handle. However, in the apparatus 8, the plunger that is retracted is aligned with the axis of rotation 14*a* of the handle 10, whereas in the prior art, L-shaped handles retract a plunger that is perpendicular to the axis of rotation.

Figure 3:
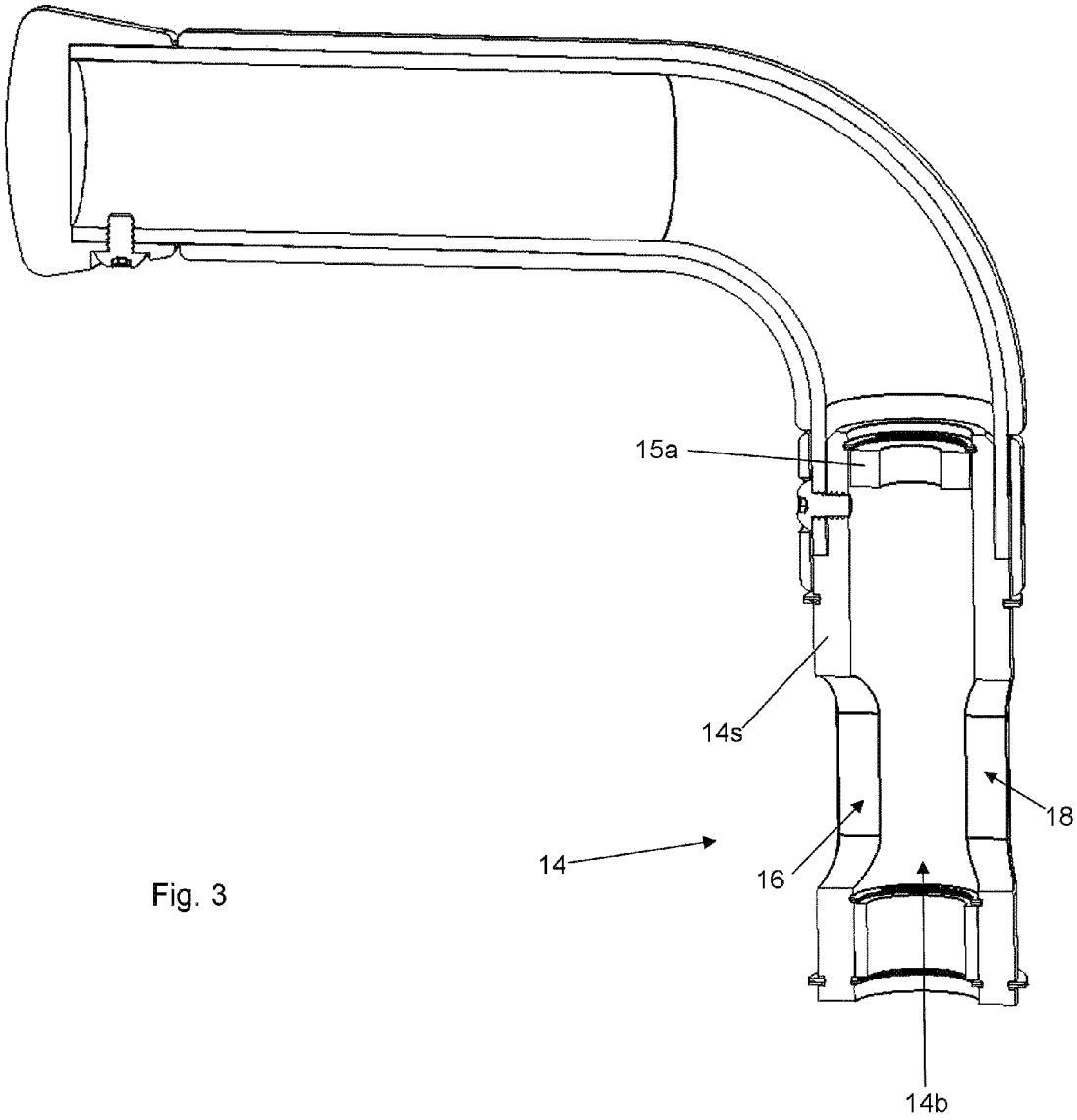
FIG. 3 is a side view in section illustrating a handle component of the apparatus of FIG. 2 along the line 3-3.

The second end 14 is a preferably tubular cylinder having a sidewall 14*s* that defines a barrel-shaped void 14*b* therein, as best viewed in FIG. 3. Elongated slots 16 and 18 are formed in opposing sides of the sidewall 14*s*, and axes of the slots are preferably aligned substantially parallel to each other and to the central axis 14*a*. At one end of the barrel-shaped void 14*b*, a shoulder 15*a* is mounted to provide a surface for a top end of the spring 30 (see FIG. 4) to seat against, as is described in more detail below.

Figure 4:
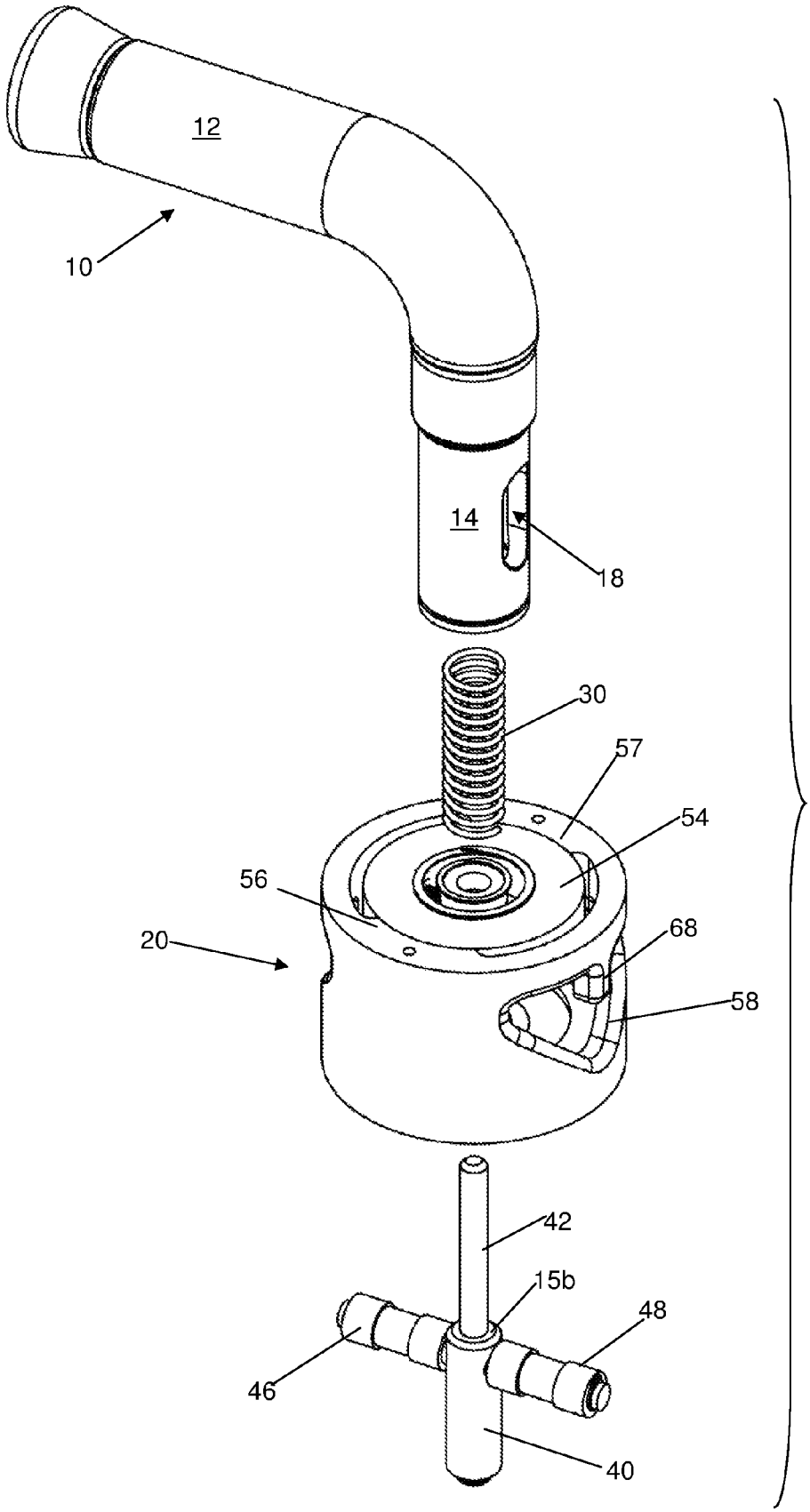
FIG. 4 is an exploded view in perspective illustrating the embodiment of FIG. 2.
Figure 5:
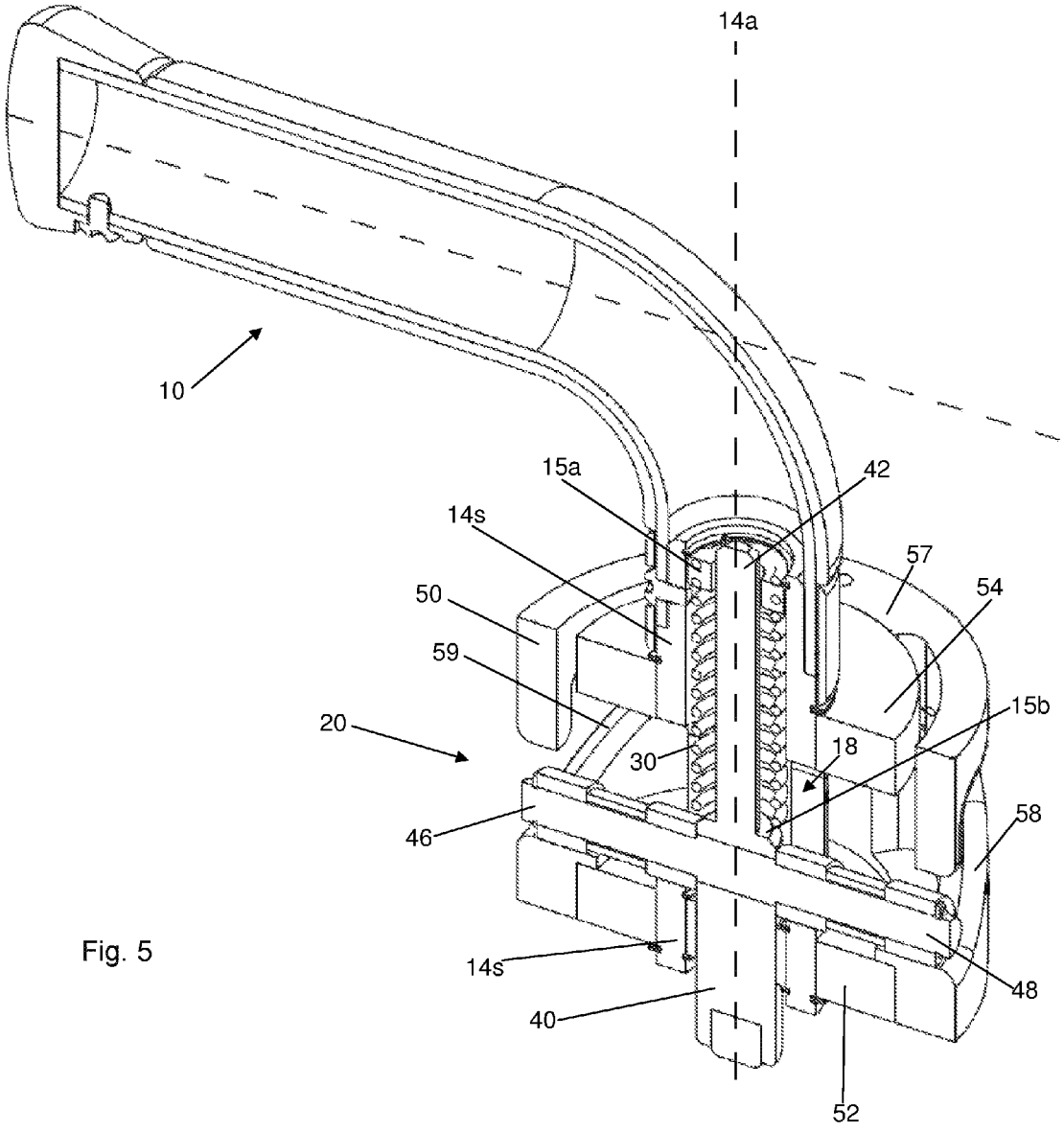
FIG. 5 is side view in section illustrating the entire apparatus of FIG. 2 along the line 3-3.

As shown in FIGS. 4 and 5, the plunger 40 is transversely (preferably perpendicularly) intersected by a pair of oppositely-directed roller bars 46 and 48 rigidly attached thereto. Although one bar can be used, it is preferred to use two opposing roller bars. The roller bars 46 and 48 are preferably cylindrical shafts extending through a bore formed through the plunger 40 with conventional roller bearings rotatably mounted neat the ends thereof. With this configuration, the roller bars 46 and 48 readily roll over any solid surface upon which they are placed, rather than having a sliding, high-friction engagement. The roller bars 46 and 48 mounted in the slots 16 and 18 limit the movement of the plunger 40 relative to the handle 10 to longitudinally along the central axis 14*a*. Thus, the plunger 40 cannot rotate relative to the handle end section 14.

The pin 42 extends upwardly along the same axis as the plunger 40 and is also in the barrel 14*b*, as best viewed in FIG. 5. Furthermore, the central axis 14*a* is coincident with the axis of the plunger 40 and the pin 42. The pin 42 is essentially an extension of the plunger 40 on the opposite side of the roller bars 46 and 48 from the plunger 40, inasmuch as the pin 42 is rigidly mounted to, coaxial and collinear with, and moves with the plunger 40. Thus, when the plunger 40 is discussed herein, the pin 42 should be considered an extension of the plunger 40 past the roller bars.

The spring 30 seats against the shoulder 15*b* on the top end of the plunger 40, and, at its opposite end, against the shoulder 15*a*, and the spring 30 is pre-compressed when positioned between the shoulders 15*a* and 15*b* as shown in FIG. 5. The plunger 40 is thus biased away from the shoulder 15*a* by the spring 30. This bias is directed substantially along the central axis 14*a*, and returns the plunger 40 to the position shown in FIG. 5 when the forces acting on the plunger, roller bars 46 and 48 or pin 42 are less than necessary to compress the spring 30. An equivalent spring could be substituted for the spring 30, including without limitation a gas spring, a magnetic spring, an elastomeric spring and gravity.

As shown in FIG. 5, the collar body 20 is made up of a preferably cylindrical collar sidewall 50 into which the second end 14 of the handle 10 inserts. The handle's second end 14 is inserted into the collar body 20 in such a configuration that the second end 14 can rotate about the central axis 14*a* relative to the collar body 20. There are many structural ways this can be accomplished according to the invention, and the structures shown and described herein are examples of the many other relatively rotatable structures that can be used as substitutes.

In the embodiment shown, the lower (in the orientation shown in FIG. 5) tip of the second end 14 inserts through an aperture formed in a shoulder 52 extending radially inwardly from the lower end of the collar sidewall 50. This forms a bearing allowing the second end 14 to rotate relative to the shoulder 52 at the contact point around the second end 14. A thrust bearing can be inserted therebetween in order to both provide smooth rotational movement of the handle 10 relative to the collar body 20, and to prevent movement of the handle along the central axis 14*a*, i.e., to prevent movement of the handle 10 out of a plane through which the first end 12 passes while rotating about the central axis 14*a*. A second shoulder 54 rigidly mounts to the second end 14 at the opposite longitudinal end of the collar sidewall 50, and bears against the radially inwardly extending ears 56 and 57 (see FIGS. 4 and 5). This pair of bearings on the collar body 20 and interfacing with the second end 14 of the handle 10 at two spaced locations along the central axis ensures that the second end 14 pivots about the central axis 14*a* only.

Figure 6:
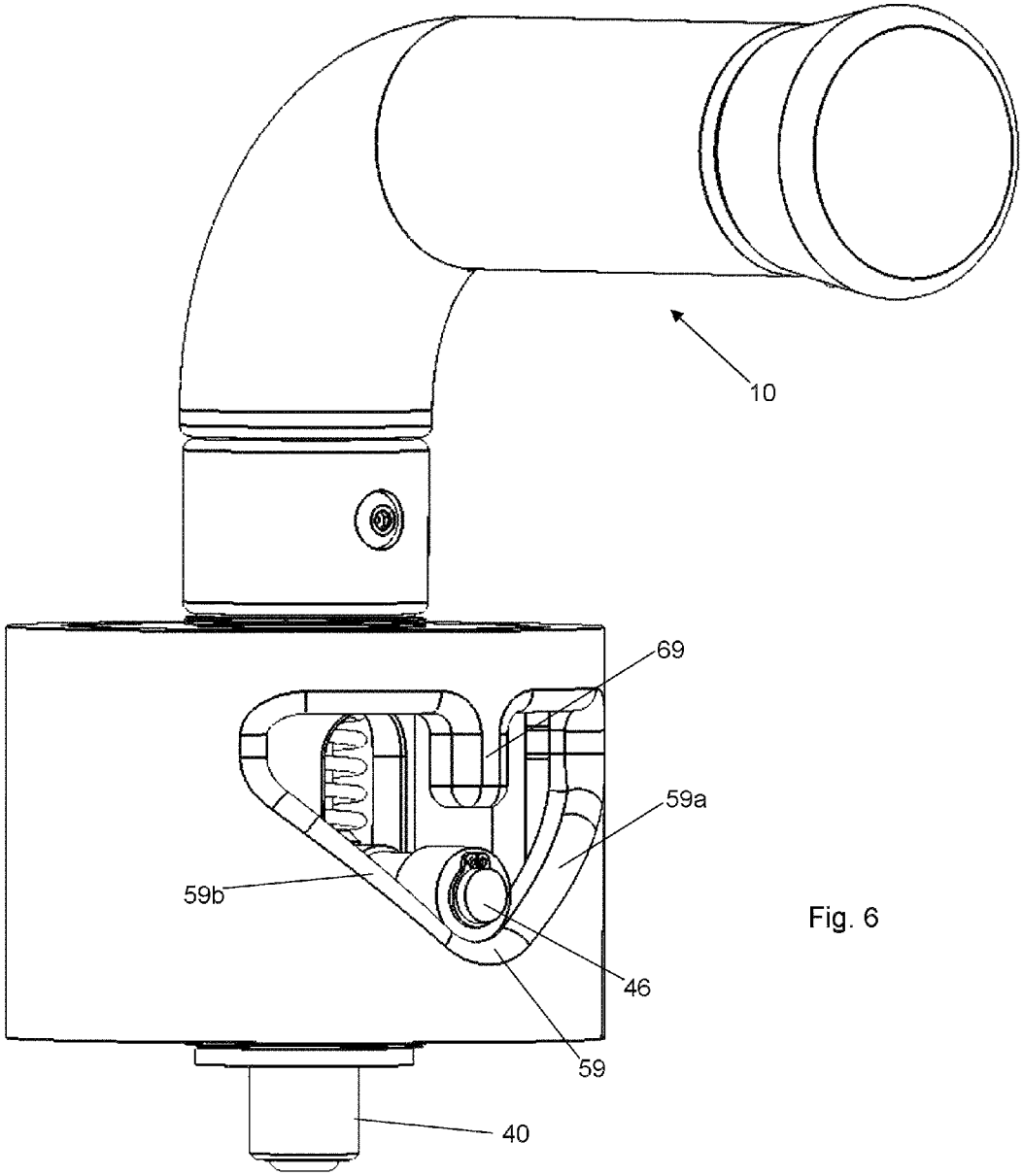
FIG. 6 is a view in perspective illustrating the embodiment of FIG. 2 from the side beneath the handle.

It is apparent from FIGS. 4, 5 and 6 that two substantially triangular openings are formed in the sidewall 50 as defined by the surfaces 58 and 59. The openings receive the roller bars 46 and 48, which extend through the slots 16 and 18, respectively and seat against the surfaces 59 and 58, respectively. When the roller bars 46 and 48 rest on the lowest point of the surfaces 59 and 58, respectively, as biased by the spring 30, the plunger 40 protrudes the maximum distance from the apparatus 8 as shown in FIG. 5. The spring 30 biases the roller bars 46 and 48 to this lowest position. When the first end 12 of the handle 10 is rotated about the central axis 14*a* in one direction, the lateral edges that define the slots 16 and 18 seat against the roller bars 46 and 48, causing the roller bars to rotate with the second end 14. As the roller bars pivot, the surfaces 58 and 59 force the roller bars to roll upwardly along the angled surfaces 59 and 58 toward the spring. As the roller bars 46 and 48 follow the angled surfaces 59 and 58, respectively, the slots 16 and 18 allow the roller bars 46 and 48, and the attached plunger 40 and pin 42, to be driven upwardly (in the orientation of FIG. 5), thereby compressing the spring 30 and retracting the plunger 40.

When the first end 12 of the handle 10 is rotated in a second, opposite direction about the central axis 14*a* from the fully-extended plunger position shown in FIG. 5, the roller bars 46 and 48 roll upwardly along the angled surfaces 59 and 58 in the opposite direction, thereby following the angled surfaces 59 and 58 upwardly, respectively, as lateral edges that define the slots 16 and 18 force the roller bars to pivot. The slots 16 and 18 allow the plunger 40 and pin 42 to be driven upwardly (in the orientation of FIG. 5), thereby similarly compressing the spring 30 and retracting the plunger 40. Because the surfaces 58 and 59 defining the openings are substantially similarly shaped and are substantially symmetrical on both sides of the lowest point, the plunger is retracted substantially the same whether the handle is rotated to one direction or the other, and the plunger 40 is only retracted when the handle 10 is pivoted in one direction or the other from the fully extended plunger position shown in FIG. 5. Conversely, the plunger 40 always retracts when the handle is rotated either direction from the fully extended plunger position shown in FIG. 5. Of course, the person having ordinary skill will know from the description herein that making the openings non-symmetrical or changing the angles of the openings will have corresponding benefits and disadvantages, and therefore such modifications are contemplated. In the invention described, the preferred handle 10 rotates about 30 degrees both directions from a center position, which retracts the plunger about 0.625 inches. Of course, this can be modified.

Figure 2:
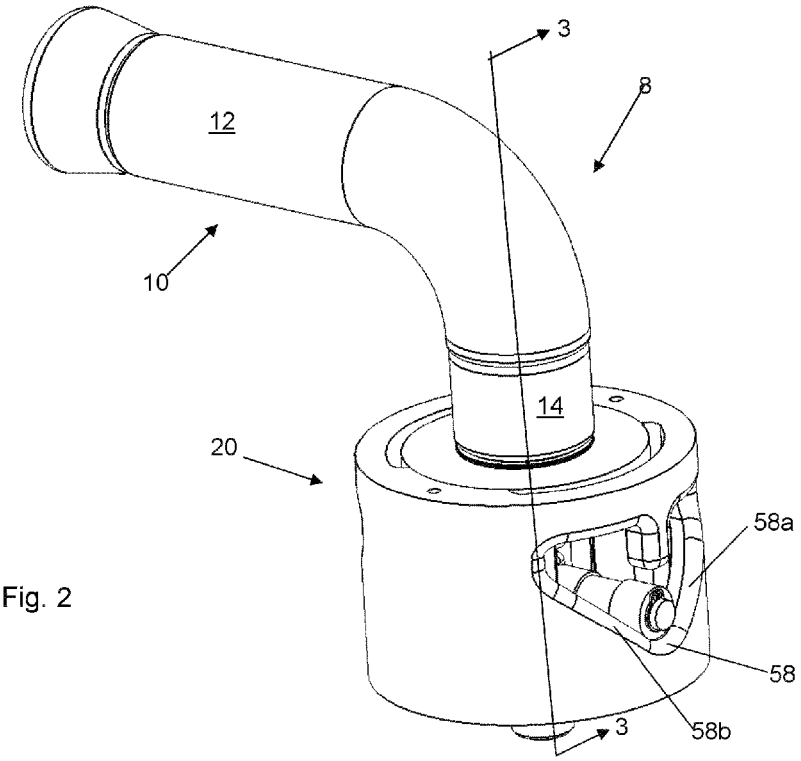
FIG. 2 is a view in perspective illustrating an apparatus embodying the present invention.

As shown in FIGS. 2 and 4, the opening defined by the surface 58 is substantially triangular, with one surface 58*a*, and a second surface 58*b* forming a V-shaped pair of surfaces, with the lowest point at the crotch of the V, upon which the roller bar 48 rolls upon rotation of the handle 10 about the central axis 14*a*. When the handle is rotated, the roller bar 48 is driven to follow the surface 58*a*, the roller bar drives the pin 42 and the attached plunger 40 along the central axis toward the first end 12, thereby compressing the spring 30 as the plunger 40 retracts by withdrawing into the collar body 20.

Similarly, when the roller bar 48 follows the surface 58*b* when the handle 10 is rotated in the direction opposite that described above, the roller bar again drives the pin 42 and the attached plunger 40 along the central axis toward the first end 12, thereby compressing the spring 30. Furthermore, during this movement the first end 12 does not move longitudinally along the central axis 14*a*, meaning the first end 12 remains in the plane in which it pivots. Thus, whether the handle's first end 12 is pivoted in one direction or the opposite from the lowest point, the plunger is retracted into the collar body 20 and the handle remains in the plane in which it began. Still further, because the spring 30 is compressed by rotation of the handle in either direction, there is gentle resistance to such rotation, and the natural resting point of the handle is when the roller bars are in the lowest point.

It should be noted that the first end 12 does not move along the central axis 14*a*, meaning that the first end 12 remains in the plane in which it pivots about the central axis. The apparatus 8 allows a user to pivot the first end 12 using a fist, elbow or any other body part to retract the plunger 40, without concern that the handle 10 will be displaced in any direction other than the direction it is driven by the user. This is highly advantageous for users with low dexterity, because the movement of the handle 10 does not introduce complexities in movement that can create problems.

There are optional fingers 68 and 69 (FIGS. 4 and 6) that extend into the substantially triangular-shaped openings defined by the surfaces 58 and 59, respectively. These fingers 68 and 69 permit a user to rotate the handle 10 to one extreme direction, but then move the apparatus 8, and the structure to which it is attached, in the opposite direction than that in which the rotating force is applied. For example, when the handle 10 shown in FIG. 6 is rotated to the right in the illustration, the roller bar 46 rolls up the surface 59*a* to the right in the illustration, and stops when it meets the upper corner of the triangle defined by the surface 59. (The same occurs on the opposite side with the roller bar 48 and the surface 58.) At this point, the force pivoting the handle 10 is to the right in FIG. 6, but the user wishes to push the apparatus 8 to the left. Without the fingers 68 and 69, the plunger 40 could fall back into an aperture 6*a* as the apparatus 8 and the collar 4 are slid along the arm 6. Instead, because of the fingers 68 and 69 the roller bars 46 and 48 seat against the fingers 68 and 69 due to the force to the left in FIG. 6, and are prevented from dropping down into the lowest point of the V-shaped opening, which would permit the plunger 40 to be inserted into one of the apertures 6*a* that is passed as the collar 4 is slid along the arm 6. Upon release of the force when the apparatus 8 and collar 4 approach the desired location, the plunger 40 will be driven by the bias of the spring 30 into the desired aperture 6*a*.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A mechanism for displacing a plunger, the mechanism comprising:

(a) a handle having at least first and second intersecting end sections that are transverse to one another, the second end section having a substantially cylindrical sidewall defining a barrel with a central axis, the sidewall having at least one elongated slot formed therein that is substantially parallel to the central axis;

(b) a plunger longitudinally slidably mounted in the barrel, wherein the plunger is coaxial with the central axis;

(c) at least one bar extending transversely from rigid attachment to the plunger through said at least one elongated slot in the sidewall; and (d) a collar body rotatably mounted to the second end section of the handle, the collar body having a collar sidewall with at least one surface defining an opening, the opening receiving said at least one bar resting upon said at least one surface, wherein upon rotation of the first end section of the handle about the central axis, the bar is driven by a sidewall edge defining said at least one elongated slot to follow said at least one surface to thereby drive the plunger longitudinally along the central axis.

2. The mechanism in accordance with claim 1, further comprising a spring that biases the plunger away from the first end section of the handle.

3. The mechanism in accordance with claim 2, wherein the first end section is configured to be displaced through a plane of travel that is substantially perpendicular to the central axis, and the first end section cannot, in normal use, be displaced out of said plane of travel.

4. A mechanism for displacing a plunger, the mechanism comprising:

(a) a handle having at least first and second intersecting end sections that are transverse to one another, the second end section having a substantially cylindrical sidewall defining a barrel with a central axis, the sidewall having at least one elongated slot formed therein that is substantially parallel to the central axis;

(b) a plunger longitudinally slidably mounted in the barrel, wherein the plunger is coaxial with the central axis;

(c) at least one bar extending transversely from rigid attachment to the plunger through said at least one elongated slot in the sidewall; and (d) a collar body rotatably mounted to the second end section of the handle, the collar body having a collar sidewall with at least one surface defining an opening, the opening receiving said at least one bar resting upon said at least one surface, wherein upon rotation of the first end section of the handle about the central axis, the bar is driven by a sidewall edge defining said at least one elongated slot to follow said at least one surface to thereby drive the plunger longitudinally along the central axis; and (e) a spring that biases the plunger away from the first end section of the handle, wherein the first and second openings are substantially triangular.

5. A mechanism for retracting a plunger along a central axis during rotation of a handle about the central axis, the mechanism comprising:

(a) the handle having at least first and second substantially perpendicular end sections, the first end section being mounted to pivot about the central axis and the second end section having a substantially cylindrical handle sidewall defining a barrel that is coaxial with the central axis, the handle sidewall having first and second opposed, elongated, substantially parallel slots formed therein that are substantially parallel to the central axis;

(b) a plunger longitudinally slidably mounted in the barrel, wherein the plunger is coaxial with the central axis;

(c) a spring that biases the plunger away from the first end of the handle;

(d) first and second opposing roller bars extending from rigid attachment to the plunger through the opposed elongated slots; and (e) a collar body in which the handle sidewall is rotatably mounted, the collar body having a collar sidewall with opposed first and second surfaces defining opposed first and second openings, respectively, each of the first and second openings receiving a respective one of the roller bars resting upon a respective one of the first and second surfaces, wherein upon rotation of the first end section of the handle about the central axis, the roller bars follow the first and second surfaces and drive the plunger longitudinally along the central axis against the bias of the spring, thereby retracting the plunger into the collar body.

6. The mechanism in accordance with claim 5, wherein the first and second openings are substantially triangular.

7. The mechanism in accordance with claim 5, wherein the first end section is configured to be displaced through a plane of travel that is substantially perpendicular to the central axis, and the first end section cannot, in normal use, be displaced out of said plane of travel.

8. The mechanism in accordance with claim 5, further comprising first and second fingers extending from a respective one of each of the first and second openings.

9. A method of retracting a plunger along a central axis, the method comprising:

(a) mounting a handle in a collar body, (i) the handle having at least first and second substantially perpendicular end sections, the second end section having a substantially cylindrical handle sidewall defining a barrel that is coaxial with the central axis, the handle sidewall having first and second opposed, elongated, substantially parallel slots formed therein that are substantially parallel to the central axis;

(ii) a plunger longitudinally slidably mounted in the barrel, wherein the plunger is coaxial with the central axis;

(iii) a spring mounted in the barrel that biases the plunger away from the first end of the handle;

(iv) first and second opposing roller bars extending from rigid attachment to the plunger through the opposed elongated slots; and (v) the collar body having a collar sidewall with opposed first and second surfaces defining opposed first and second openings, respectively, each of the first and second openings receiving a respective one of the roller bars resting upon a respective one of the first and second surfaces; and (b) pivoting the first end section of the handle about the central axis, thereby causing sidewall edges defined by the elongated slots to drive the roller bars in pivoting movement about the central axis and along the first and second surfaces, thereby driving the plunger longitudinally along the central axis against the bias of the spring and retracting the plunger into the collar body.

10. The method in accordance with claim 9, wherein the first end section is pivoted through a plane of travel that is substantially perpendicular to the central axis, and the first end section is not displaced out of said plane of travel.

* * * * *